US010167686B2

(12) United States Patent
Gubbins et al.

(10) Patent No.: US 10,167,686 B2
(45) Date of Patent: Jan. 1, 2019

(54) CONTINUOUS WELL STRING INJECTOR USING MULTI-PISTON CYLINDER BLOCKS FOR APPLICATION OF SKATE PRESSURE

(71) Applicant: Celtic Machining Ltd., Rainier (CA)

(72) Inventors: Martin E. C. Gubbins, Rainier (CA); Sven W. Larsen, Rainier (CA)

(73) Assignee: Celtic Machining Ltd., Rainier, AB ( * ) Notice: Subject to any disclaimer, the term of this patent is extended or adjusted under 35 U.S.C. 154(b) by 491 days.

(21) Appl. No.: 15/067,338

(22) Filed: Mar. 11, 2016

(65) Prior Publication Data

US 2016/0265290 A1 Sep. 15, 2016

Related U.S. Application Data

(60) Provisional application No. 62/131,299, filed on Mar. 11, 2015.

(51) Int. Cl.

| | |
|---|---|
| ***E21B 19/08*** | (2006.01) |
| ***E21B 19/22*** | (2006.01) |
| ***B66D 3/00*** | (2006.01) |
| ***B65H 51/10*** | (2006.01) |

(52) U.S. Cl.

CPC ..... *E21B 19/08* (2013.01); *B65H 51/105* (2013.01); *B66D 3/003* (2013.01); *E21B 19/22* (2013.01)

(58) Field of Classification Search

CPC ..... B65H 51/105; B65H 51/10; B65H 2301/44316; B65H 2555/12; B65H 2701/33; B65H 2553/12; B66D 3/003; E21B 19/08

See application file for complete search history.

(56) References Cited

U.S. PATENT DOCUMENTS

| | | | | |
|---|---|---|---|---|
| 5,775,417 A * | 7/1998 | Council | B65H 51/14 | 166/77.3 |
| 5,918,671 A * | 7/1999 | Bridges | E21B 19/22 | 166/77.3 |
| 6,173,769 B1 * | 1/2001 | Goode | E21B 19/22 | 166/77.3 |
| 6,209,634 B1 * | 4/2001 | Avakov | E21B 19/22 | 166/77.3 |
| 6,216,780 B1 * | 4/2001 | Goode | B65H 51/14 | 166/385 |

(Continued)

*Primary Examiner* — Michael C McCullough

(74) *Attorney, Agent, or Firm* — Kyle R. Satterthwaite; Ryan W. Dupuis; Ade & Company Inc.

(57) ABSTRACT

A continuous well string injector features a frame carrying a pair of endless chain conveyors on opposite sides of a pathway. Each chain carries gripper dies for engaging the continuous well string when received in the pathway. A respective skate and cylinder block reside in the closed loop path of each chain. Each cylinder block features a plurality of blind bores having open ends facing toward the respective skate, and a respective piston is slidably disposed within each bore. Hydraulic extension and retraction ports open into the cylinder bores on opposite sides of the piston, whereby back and forth displacement of the pistons forces the skates toward and away from one another to grip and release the continuous well string. A front wall of the frame has an open horizontal gap aligned with the pathway to enable lateral entrance and exit of the continuous string to and from the pathway.

14 Claims, 8 Drawing Sheets

(56) References Cited

U.S. PATENT DOCUMENTS

| | | | | |
|---|---|---|---|---|
| 6,347,664 | B1 * | 2/2002 | Perio, Jr. | E21B 19/22 166/77.3 |
| 9,399,895 | B2 * | 7/2016 | Goddard | E21B 19/22 |
| 2003/0209346 | A1 * | 11/2003 | Austbo | B65G 23/14 166/77.2 |
| 2009/0250205 | A1 * | 10/2009 | Koopmans | E21B 19/22 166/66.4 |
| 2016/0069143 | A1 * | 3/2016 | Gubbins | B66D 3/003 166/77.3 |
| 2016/0076372 | A1 * | 3/2016 | Kallis | F01B 3/0055 91/6.5 |
| 2016/0333649 | A1 * | 11/2016 | Bjornenak | E21B 19/22 |

* cited by examiner

CONTINUOUS WELL STRING INJECTOR USING MULTI-PISTON CYLINDER BLOCKS FOR APPLICATION OF SKATE PRESSURE

CROSS REFERENCE TO RELATED APPLICATIONS

This application claims benefit under 35 U.S.C. 119(e) of Provisional Application Ser. No. 62/131,299, filed Mar. 11, 2015.

FIELD OF THE INVENTION

The present invention relates generally to well string injectors used to inject continuous rod or tubing string into a wellbore by gripping the string between gripping dies on counter-rotating conveyor chains that respectively loop around a pair of skates, and more particularly to an injector in which a respective bank of pistons contained in a respective cylinder block acts on each skate to force the conveyor chains together during gripping of a continuous string therebetween.

BACKGROUND

Coiled tubing is commonly used in the oilfield industry, and it is also becoming more common to employ continuous coiled rod instead of conventional sucker rod, for example for the purpose of driving downhole pump equipment, thereby avoiding the need to thread together discrete rod sections via threaded couplers at the ends thereof.

Injectors for coiled tubing or continuous rod typically employ a pair of endless chains driven in counter-rotating directions in a common upright plane, and carrying gripper dies or blocks on the chains that have outward facing gripping surfaces to clench the continuous rod between the faces of opposed gripper dies on the two chains as they descend downward on adjacent, facing-together, parallel sides of the two chain paths. A respective skate is found inside the area around which each chain is driven in order to lie along this descending side of the chain, and the skates are displaceable toward one another, typically by hydraulic cylinders connected between the skates on opposite sides of the chains closing therearound, thereby forcing the descending gripper blocks toward one anotherto firmly grip the coil tubing or continuous rod between them.

Prior art in the general area of injector heads and gripper dies for same includes U.S. Pat. Nos. 5,094,340, 5,553,668, 5,918,671, 6,425,441, 6,516,891, 6,609,566, 6,880,629, 6,892,810, 7,051,814, 7,857,042 and 8,132,617, and U.S. Patent Application Publication 2012/0222855.

U.S. Pat. No. 5,133,405 of Elliston discloses a different style of coiled tubing injector in which only a single endless chain is employed instead of gripping the continuous string between grippers of two endless chains that are forced together by hydraulically displaced skates. The single chain configuration provides the unit with an 'open face' design, by which the injector can laterally engage with or disengage from the continuous string from a position therebeside, rather than requiring vertical insertion and withdrawal of the continuous string into and from the injector. The design relies on a hinged construction by which two halves of each gripper open and close to receive, grip and release the continuous string.

It would be desirable to achieve an open-face injector head design that could accommodate lateral placement of the injector on a previously deployed string of continuous rod that already resides downhole without relying on an openable and closeable two-piece gripper design like that of Elliston.

In conventional dual-chain injectors that use skates to force together the gripping dies of the two chains at facing together sides of their closed-loop paths, the ability to laterally engage the injector with the continuous string is prevented by the presence of hydraulic cylinders laterally interconnecting the two skates with one another across the gap between the chains in which the continuous string is to be received.

U.S. Patent Application Publication 2013/0240198 discloses an alternative coiled tubing injector design in which the conventional set of hydraulic cylinders extending between the two skates is replaced with a separate bank of cylinders for each skate. The respective bank of cylinders for each skate acts against the outer side of the skate to push it toward the other skate and grip the continuous rod between the dies of the two chains closing respectively around the skates. However, the frame of Hassard's injector lacks an open face that would accommodate lateral placement and removal of the injector to and from the continuous string.

Applicant has developed a new continuous rod injector providing open-face lateral access, which has a unique combination of features not seen in the prior art, parts of which may also prove useful in continuous coiled tubing applications and even in closed-faced injector frame designs.

SUMMARY OF THE INVENTION

According to a first aspect of the invention, there is provided an apparatus for injecting or withdrawing a continuous string into and from a wellbore, the apparatus comprising:

a frame;

a pair of endless drive conveyors positioned on different respective sides of a pathway in which a length of the continuous string is receivable, each endless drive conveyor comprising an endless chain and a plurality of gripper dies coupled to the endless chain, each gripping die having a gripping face that faces outwardly from the endless chain and is shaped to engage a periphery of the continuous string and a base surface that faces inwardly from the endless chain, the endless chains entrained about respective set of sprockets that are rotatably mounted on the framework for driven movement around respective closed-loop paths on the different sides of the pathway such that the gripper dies of each endless chain are conveyed in a same direction along the pathway at the respective side thereof during a portion of the respective closed-loop path;

a pair of skates respectively residing on the different respective sides of the pathway with the closed-loop path of each endless chain closing around a respective one of the skates; and a pair of cylinder blocks respectively residing within the closed loop paths of the endless chains, each cylinder block featuring a plurality of blind bores having open ends facing toward the one of the skates located within the closed-loop path of the same endless chain, and closed ends lying opposite to said open ends;

a respective piston disposed within each bore and slidable back and forth in an axial direction of the bore;

a respective connection between each piston and the one of the skates located within the closed-loop path of the same endless chain, whereby back forth displacement of the pistons within each cylinder block causes back and forth displacement of the one of the skates located within the closed-loop path of the same endless chain, thereby moving the skate toward and away from the cylinder block; and hydraulic extension ports opening into the cylinder bores of each cylinder block between the pistons and the closed ends of the cylinder bores for extension of said skate away from the cylinder block under pressurized introduction of hydraulic fluid into the cylinder bores through said hydraulic extension ports.

According to a second aspect of the invention, there is provided an apparatus for injecting or withdrawing a continuous string into and from a wellbore, the apparatus comprising:

an upright framework;

a pair of endless drive conveyors positioned on different respective sides of a pathway in which a length of the continuous string is receivable, each endless drive conveyor comprising an endless chain and a plurality of gripper dies coupled to the endless chain, each gripping die having a gripping face that faces outwardly from the endless chain and is shaped to engage a periphery of the continuous string and a base surface that faces inwardly from the endless chain, the endless chains entrained about respective set of sprockets that are rotatably mounted on the framework for driven movement around respective closed-loop paths on the different sides of the pathway such that the gripper dies of each endless chain are conveyed in a same direction along the pathway at the respective side thereof during a portion of the respective closed-loop path;

a pair of skates respectively residing on the different respective sides of the pathway with the closed-loop path of each endless chain closing around a respective one of the skates; and a pair of cylinder blocks respectively residing within the closed loop paths of the endless chains, each cylinder block featuring a plurality of bores having open ends facing toward the one of the skates located within the closed-loop path of the same endless chain;

a respective piston disposed within each bore and slidable back and forth in an axial direction of the bore;

a respective connection between each piston and the one of the skates located within the closed-loop path of the same endless chain, whereby back forth displacement of the pistons within each cylinder block causes back and forth displacement of the one of the skates located within the closed-loop path of the same endless, thereby moving the skate toward and away from the cylinder block; and hydraulic extension ports opening into the cylinder bores of each cylinder block between the pistons and the closed ends of the cylinder bores for extension of said skate away from the cylinder block under pressurized introduction of hydraulic fluid into the cylinder bores through said hydraulic extension ports;

wherein the upright frame comprises front and rear walls standing upright on opposite sides of the skates and the pathway therebetween, each cylinder block being fastened to each of the front and rear walls and residing in a space between said front and rear walls, within which the skates are movable toward one another by pressurization of the cylinder bores of both skates through the hydraulic extension ports thereof to grip the length of continuous string, and the front wall being split into two portions separated by a horizontal gap therebetween, the horizontal gap being elongated in an upright direction and aligning with the pathway between the endless drive conveyors to enable lateral entrance and exit of the continuous string to and from the pathway via the horizontal gap in the front wall of the frame.

Preferably the gap in the front wall extends from a bottom end of the front wall toward an opposing top end thereof, and stops short of said top end to leave a bridging portion of the front wall intact over the gap to connect the two portions of the front wall together.

Preferably there is provided a guide member spanning between the front and rear walls at the top end in a position overlying the pathway between the two endless chain conveyors, and having an opening passing downwardly through the guide member to enable feeding of the length of continuous string into the pathway through the guide member.

Preferably there are provided hydraulic retraction ports opening into the cylinder bores on sides of the pistons opposite to the hydraulic extension ports for retraction of said skate toward the cylinder block under pressurized introduction of hydraulic fluid into the cylinder bores through said hydraulic retraction ports;

Preferably the hydraulic extension ports of each cylinder block are in fluid communication with one another, and a single respective fluid supply line is connected to each cylinder block for supplying hydraulic fluid to all of the hydraulic extension ports.

Preferably the hydraulic extension ports of each cylinder block are communicated with one another via a respective set of extension-side fluid connection passages recessed into said cylinder block.

Preferably the hydraulic retraction ports of the cylinder bores in each cylinder block are in fluid communication with one another, and a single respective fluid return line is connected to each cylinder block for supplying hydraulic fluid to all of the hydraulic retraction ports.

Preferably the hydraulic retraction ports of each cylinder block are communicated with one another via a respective set of retraction-side fluid connection passages recessed into said cylinder block.

Preferably there is provided at least one hydraulic accumulator connected between a hydraulic fluid source and the hydraulic extension ports of the cylinder blocks.

Preferably the at least one hydraulic accumulator comprises a first and second hydraulic accumulators respectively connected to the pair of cylinder blocks.

Preferably there is provided a respective retaining flange for each cylindrical bore, said respectively retaining flange being mounted to a face of the cylinder block at which the open end of the cylinder bore resides and partly occluding said open end of the cylinder bore to prevent exit of the piston from the cylinder bore during extension of the piston.

Preferably there is provided at least one pair of mating slide members for each skate, each pair comprising a first slide member mounted on the respective skate, and a second slide member mated with the first slide member and mounted on the frame, the first and second slide members being slidable relative to one another on an axis lying parallel to the axial direction of the bores in the cylinder blocks to guide movement of the respective skate under actuation of the pistons.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
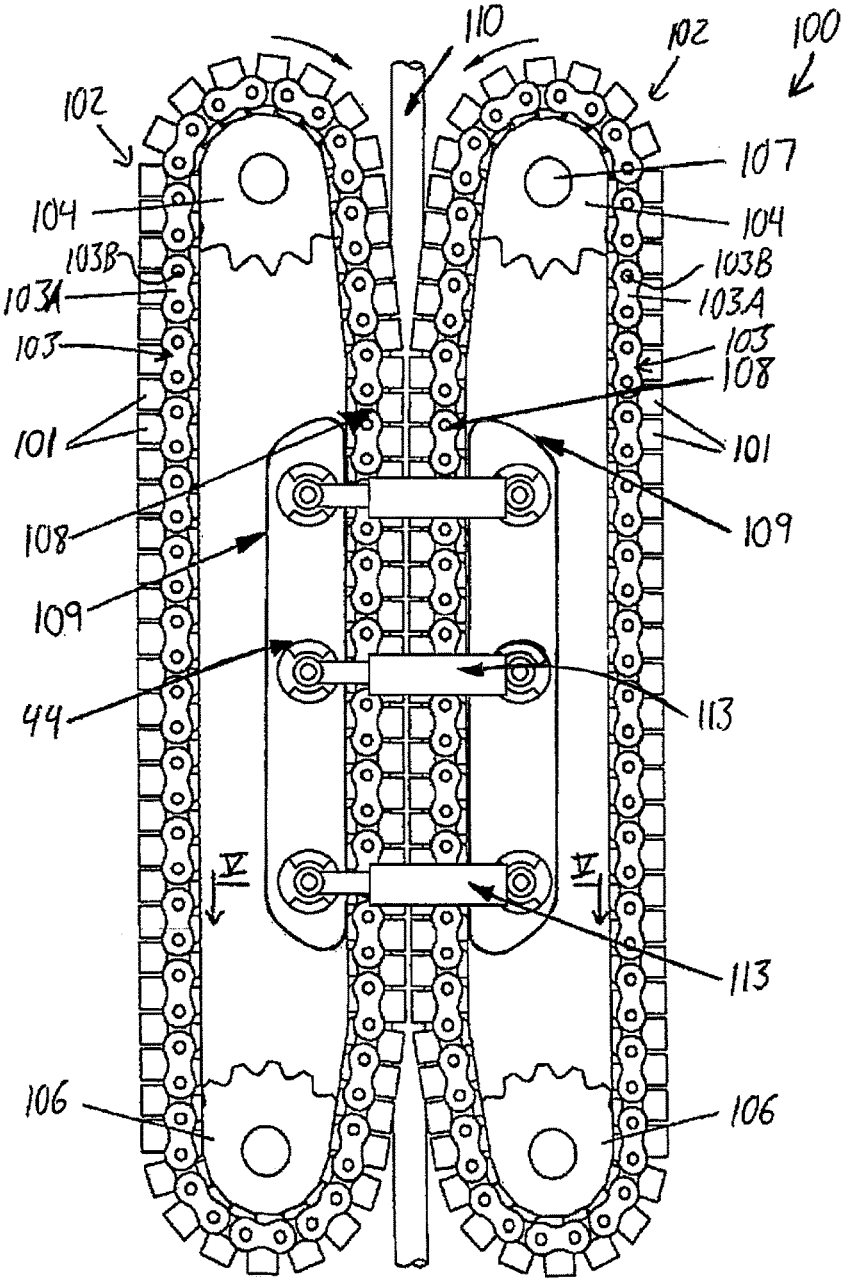
FIG. 1 PRIOR ART
FIG. 1 is a schematic front elevational view of a prior art injection head employing conventional hydraulic cylinders connected between two skates of the injector to apply pressure for gripping a length of continuous coiled rod or tubing between gripping dies of counter-rotating conveyor chains.

FIG. 1 schematically illustrates the general layout of an injector head 100 of a known type operable to convey lengths of continuous rod or tubing into and out of a well. The injector 100 comprises a frame (not shown) that supports two continuous, endless conveyor chain assemblies 102 thereon for rotation of the two chain assemblies in counter-rotating directions within a common vertical plane. Each of the chain assemblies features at least one chain 103 entrained about at least an upper sprocket 104 and a lower sprocket 106, one of which is driven for rotation by the drive shaft 107 of a suitable drive source (not shown), and the other of which may be an idler sprocket arranged to take up the slack in the chain. The path of each of the chain assemblies 102 includes an inner vertical run 108 such that the two vertical runs of the chain assemblies run parallel to one another in relatively close proximity with one another on opposite sides of a small space left between them. This space forms a longitudinal pathway arranged to receive the continuous coiled rod or tubing 110 for displacement thereof with the chains in the longitudinal direction of the rod and the vertical runs 108.

Each chain assembly 102 is completed by a plurality of gripper dies 101 of identical configuration that are coupled to the chain(s) 103 of the assembly so that the gripper dies rotate with the chain about the sprockets 104, 106 so that gripping faces of opposing gripper dies 101 of the two chain assemblies face toward one another along the vertical runs of the conveyor chains in order to grip opposing sides of the continuous rod 110 received therebetween.

In order to apply a gripping pressure to clamp or grip the coil tubing or continuous rod 110 between the opposed vertical runs of the chain assemblies, each of the vertical runs of the chain assemblies is accompanied by a skate 109 that resides adjacent the vertical run 108 of the chain assembly 102 just inside of the closed-loop path followed by the chain assembly under driven rotation of the drive sprocket 107. The purpose of the skates is to apply pressure to the chain assemblies 102 on the interior sides thereof opposite the continuous rod or tubing 110 disposed between the chain assemblies. In the conventional design of FIG. 1, this urging together of the opposed skates 109 of the two conveyor chain assemblies is performed by hydraulic actuators 113 coupled between the two skates, specifically by hydraulically powering the actuators in their collapsing or retracting direction that pulls the two skates toward one another. During this action, the gripper dies 101 on opposing sides of the rod or tubing 110 are forced toward one another, and thereby tightened against the respective sides of the continuous rod or tubing 110.

The illustrated embodiment of the present invention employs the same general configuration of two counter-rotating conveyor chain assemblies and a pair of skates for pushing the facing-together sides of the chain paths toward one another to grip the continuous string between the gripper dies of the chain assemblies, but does away with the hydraulic cylinders 113 connected between the two skates, and instead employs a unique solution that enables lateral access to the string pathway between the vertical facing-together runs of the two chain paths via an open face design of the injector frame on which the other components are carried.

Figure 2:
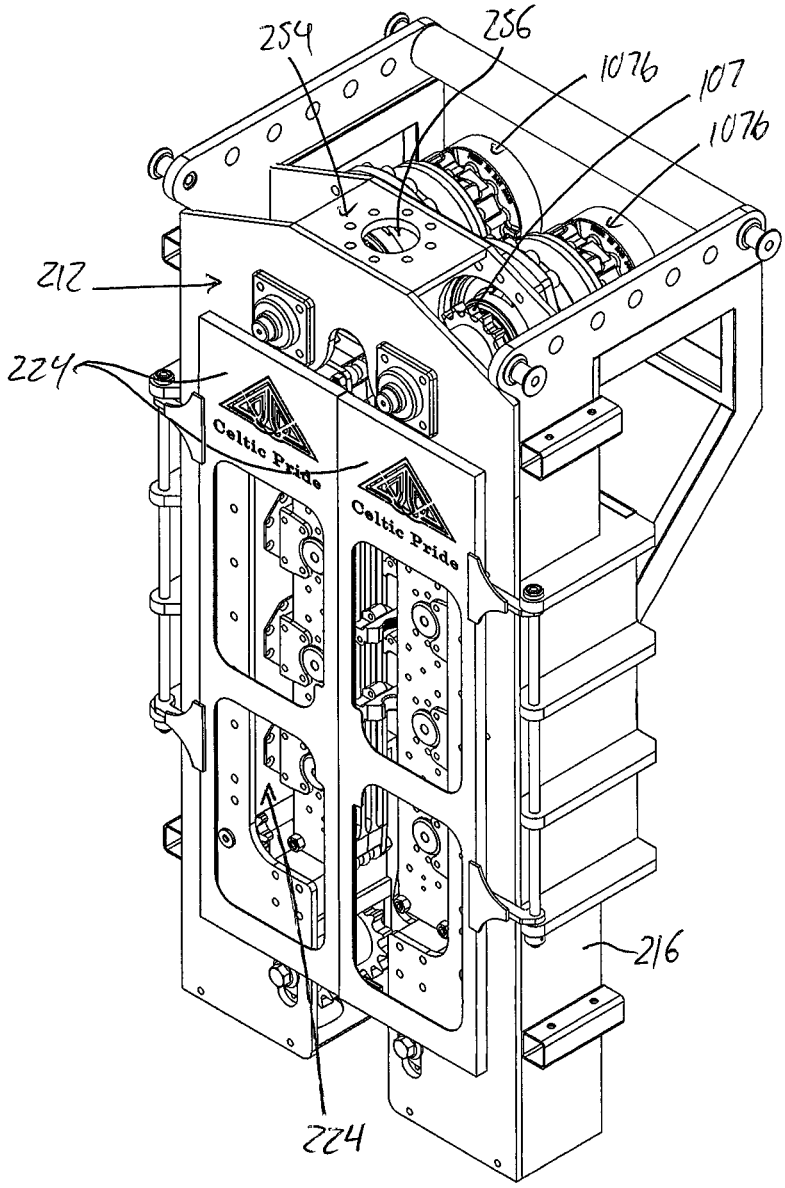
FIG. 2 is a front perspective view of an injection head of the present invention with the conventionally positioned counter-rotating conveyor chains substantially omitted for ease of illustration.

FIG. 2 shows a fully assembled injector according to one embodiment of the present invention, which features a frame 210 having an upright front wall 212 residing in a vertical plane, an upright rear wall 214 standing parallel to the front wall 212 at a horizontal distance therefrom. A vertically upright left wall 216 interconnects the front and rear walls at one pair of matching edges thereof, and a vertically upright right wall 218 interconnects the front and rear walls at an opposing pair of matching edges thereof so as to lie opposite and parallel to the left wall. A three-dimensional volume bound between the vertical planes of the walls is referred to herein an as interior space of the frame 210. The front wall 212 has a substantially sized opening 220 spanning a significant vertically-elongated area thereof, starting from the bottom end 212*a* of the front wall and extending upward to near the opposing top end 212*b* thereof. The opening 220 defines a horizontal gap that divides the intact areas of the front wall 212 into left and right side portions 212*c*, 212*d* that are separated from one another over most of the front wall's height, except at the top end where a bridging portion 212*e* interconnects the side portions.

Near the lower end 212*a* of the front wall, a pair of lower sprockets 106 are rotatably supported in the interior space between the front and rear walls on respective shafts 106*a* that span perpendicularly therebetween for respective rotation about the axes of these shafts. A corresponding upper sprocket 107 for each lower sprocket 106 is supported on a respective rotatable shaft 107*a* that spans perpendicularly between the front and rear walls 212, 214 on the same side of the opening 220 as the respective lower sprocket. An endless conveyor chain assembly is entrained about each set of upper and lower sprockets in the same conventional manner described above with reference to FIG. 1, but is substantially omitted from the figures except for a few gripper dies 101 visible in FIGS. 2 and 3. For each upper sprocket 107, a respective hydraulic motor 107*b* is mounted to the rear wall 14 of the frame at the outer surface thereof that faces way from the interior space of the frame. The hydraulic motor 107*b* is operably coupled to the rotatable shaft 107*a* of the upper sprocket 107 to drive rotation thereof under hydraulic operation of the motor.

Within the interior space of the frame, a pair of skates 109 each reside in a vertical orientation between the upper and lower sprockets of a respective one of the two sprocket sets so as to reside inside the closed-loop path of the respective chain assembly. The skates 109 of the illustrated embodiment are of the type described in Applicant's PCT Application No. PCT/CA2014/050421, published as WO/2014176702, with spherical balls defining the rolling interface between the skate and the endless chain running over the inner side thereof that faces toward the other skate, but other types of skate may alternatively be employed, including those that employ conventional cylindrical rollers. As shown, the opening 220 in the front wall may be narrower at the lower end thereof in order to provide adequate support for the lower sprockets near the bottom end of the front wall, and then increase in width further up the front wall so as to form a window through which the skates are visible and accessible. The narrower lower portion of the opening 220 in the illustrated embodiment is slightly wider than the space between the facing-together inner sides 10*a* of the two skates, and accordingly is wider than the diameter of the continuous string 110 that is gripped between the gripper dies of the endless conveyor chains during use of the injector. As shown in FIG. 2, a pair of doors 222 may hinged to the frame, one at each of the corners between the front wall 12 and the two side walls 216, 218 for movement of the doors between a closed position at least partially obstructing the opening 220, and an open position revealing full access to the opening 220. The two doors may be replaced with a single door, or omitted altogether.

Between each skate 109 and the nearest side wall 216, 218 of the frame 210 resides a respective cylinder block 224 in the shape of a vertically-elongated cuboid. Each cylinder block has an inner face 224*a* that faces toward the vertical pathway between the endless conveyors, an opposing outer face 224*b* parallel to and facing toward the nearest side wall 216, 218 of the frame 210, a front face 224*c* parallel to and facing toward the front wall 212 of the frame 210, and an opposing rear face 224*d* parallel to and facing toward the rear wall 214 of the frame 210. In FIG. 2, the inner face 224*a* of one of the cylinder blocks 224 is visible through the opening 220 in the front wall 212 of the frame 210. The other cylinder block is symmetrically positioned across the string conveyance pathway of the injector from the first cylinder block so as to reside between the other skate 109 and other side wall of the frame.

Figures 5A, 5B, 5C, 5D, 5E:
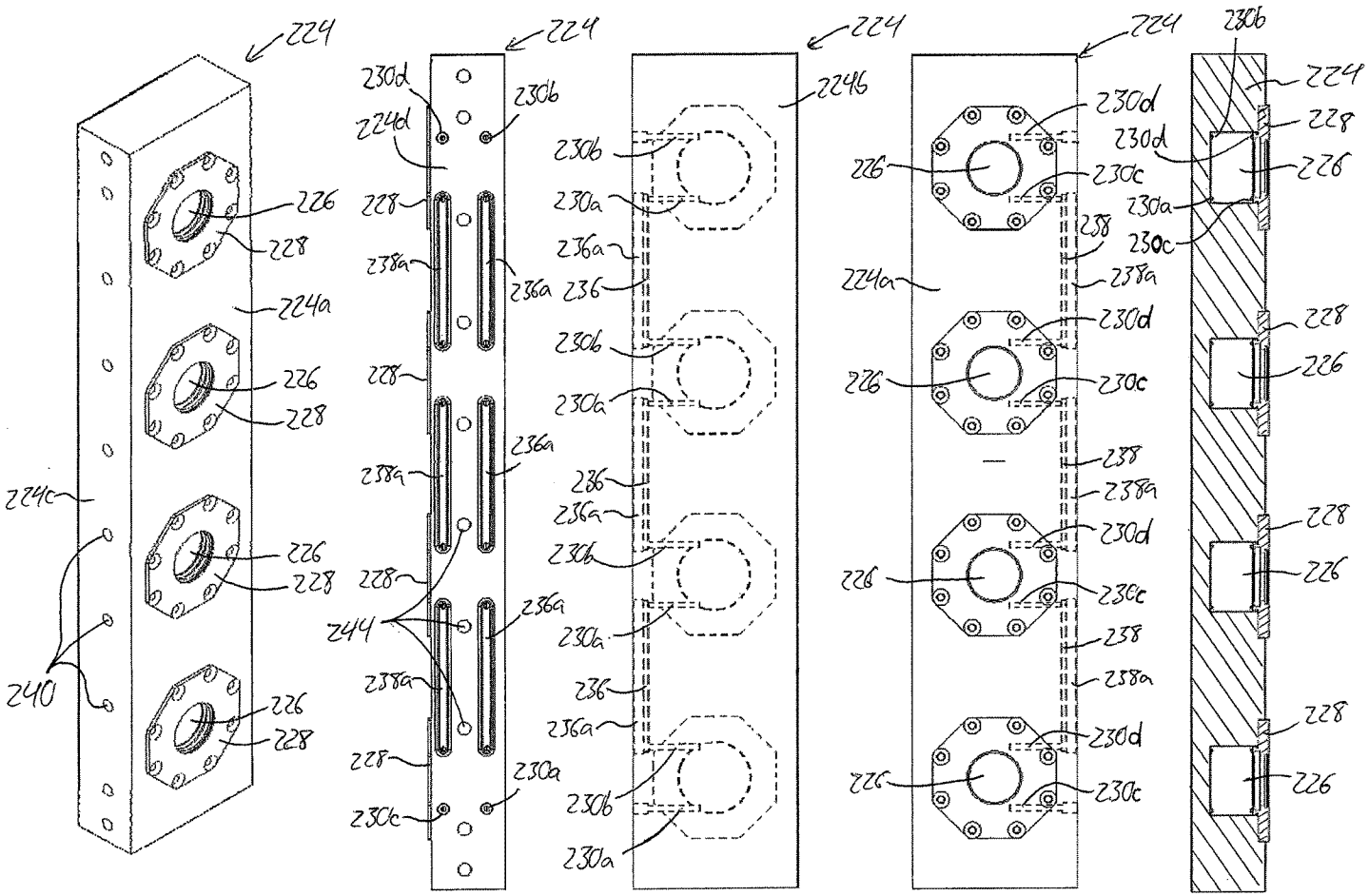
FIGS. 5A, 5B, 5C, 5D and 5E are perspective, rear, outer side, inner side and cross-sectional views of a cylinder block of the of the injection head of FIG. 2.

One of the cylinder blocks 224 is shown in isolation from the injector frame 210 in FIG. 5. The following description likewise applies to the other cylinder block. A plurality of identically sized blind cylindrical bores 226, of which there are four in the illustrated embodiment, extend horizontally into the cylinder block 224 from the inner face 224*a* thereof and feature equidistant center-to-center vertical spacing from one bore to the next. A respective flat annular retaining flange 228 is mounted to the inner face 224*a* of the cylinder block 224 over each cylindrical bore 224, and has an outer diameter and inner diameter that are respectively greater and lesser than the diameter of the cylindrical bore 224. The retaining flange thus effectively reduces the bore diameter at the open end thereof in order to retain a respective piston inside the cylindrical bore 224, as described herein further below.

From the rear face 224*b* of the cylinder lock 224, a respective set of four ports extends into each cylindrical bore through the block. This set of four ports includes an extension side inlet port 230*a* extending into the cylindrical bore adjacent the closed end thereof near the bottom of the bore, an extension side outlet port 230*b* extending into the cylinder bore adjacent the closed end thereof near the top of the bore, a retraction side inlet port 230*c* extending into the cylindrical bore adjacent the open end thereof near the bottom of the bore, and a retraction side outlet port 230*d* extending into the cylinder bore adjacent the open end thereof near the top of the bore.

Figure 6A:
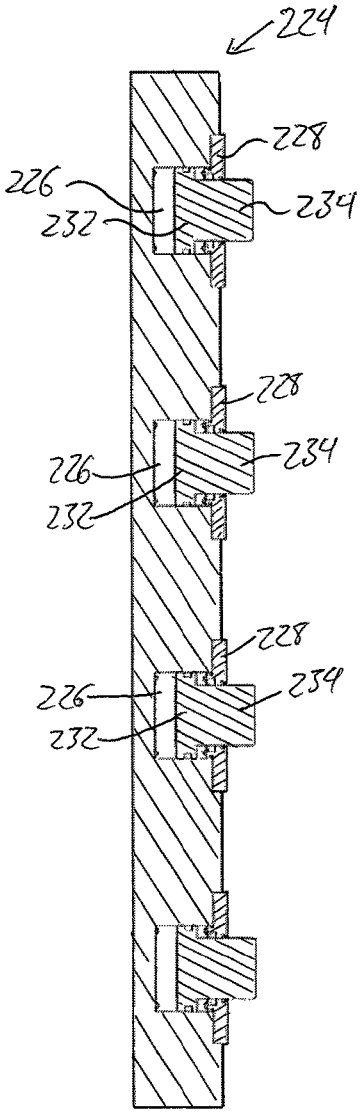
FIG. 6A is a cross-sectional view of the cylinder block of FIGS. 5A-5E with multiple pistons installed therein to act on a respective skate of the injection head in place of the conventional individual hydraulic cylinders of the prior art.

Turning briefly to FIG. 6A, a respective piston 232 is slidably disposed within each cylindrical bore 226 at an area between the extension side ports 228*a*, 228*b* and the retraction side ports 230*c*, 230*d*, and is axially movable back and forth within the bore 226 toward and away from the open end of the bore 226. A piston rod 234 projects centrally from the side of the piston that faces toward the open end of the cylindrical bore 226, and extends through the central opening in the respective retaining flange 228. The retaining flange features one or more annular seals retained therein at the boundary of its central opening in order to maintain a fluid tight seal between the retaining flange and the piston rod 234 that is axially slidable back and forth through the flange's central opening. The piston 232 similarly has one or more circumferential seals retained therearound to maintain fluid tight seal between the piston and the surrounding circumferential wall of the respective cylindrical bore 226. Suitable sealing means is also employed between the retaining flange 228 and the inner face 224*a* of the cylinder block 224 in order to prevent fluid seepage therebetween. The piston diameter exceeds the inner diameter of the retaining flange, whereby the retaining flange prevents the piston from exiting the open end of the cylindrical bore.

Turning back to FIG. 5, between each adjacent pair of cylindrical bores 226, an extension side fluid connection slot 236 connects the extension side outlet port 230*b* of one of the cylindrical bores to the extension side inlet port 230*a* of the adjacent cylindrical bore. The extension side fluid connection slot 236 is an elongated countersunk slot machined into the rear face 224*d* of the cylinder block to span between the respective pair of extension side ports. A bar of metal key stock 236*a* is welded or otherwise fastened or affixed to the block in a position filling the countersunk portion of the slot 236 and sealing closed the deeper underlying bottom portion of the slot 236 that remains open beneath the countersink in a fluid tight manner. The open space of the bottom portion of the slot thus defines a channel or passage through which hydraulic fluid can pass from the extension side outlet port 230*b* of one cylindrical bore to the extension side inlet port 230*a* of the next cylindrical bore. The metal key stock 236*a* defines a cover for sealing off this hydraulic fluid passage.

Likewise, a respective countersunk retraction side fluid connection slot 238 is machined in the rear face 224*d* of the cylinder block between each adjacent pair of cylindrical bores 226. Each such retraction side fluid connection slots extends between the retraction side outlet port 230*d* of one of the cylindrical bores to the extension side inlet port 230*c* of the adjacent cylindrical bore. Again, a piece of metal key stock 238*a* is used as a cover to close off the deeper bottom portion of the slot 238, which thus defines a hydraulic fluid flow channel or passage between the two respective ports.

At the lowermost cylindrical bore, the extension side and retraction side inlet ports do not open into respective fluid connection slots, and are instead respectively coupled to hydraulic fluid supply hoses (not shown) that connect the inlet ports to respective sources of pressurized hydraulic fluid. Pressurized fluid pumped into the extension side inlet port of the lowermost cylindrical bore pressurizes the extension side of the piston therein, thereby driving the piston toward the inner face of the cylinder block and causing the piston rod 234 to extend further therefrom. This pressurization of the extension side of the lowermost cylindrical bore likewise pressurizes the extension side of all the other cylindrical bores via the extension side fluid connection slots, whereby all of the piston rods are simultaneously extended. When the pressurized state of the extension side is removed, the retraction sides of the cylinders can be likewise pressurized via the respective supply hose coupled to the retraction side inlet port of the lowermost cylindrical bore in order to drive simultaneous retraction of all the piston rods by driving the pistons toward the outer face of the cylindrical block.

The front face 224*c* of each cylinder block 224 has a respective series of bolt holes 240 therein at vertically spaced intervals along the height thereof, which aligns with a corresponding set of bolt holes 242 in a respective one of the left and right side portions 212*c*, 212*d* of the front wall of the injector frame 210. Likewise, the rear face 224*d* of each cylinder block 224 has a series of bolt holes 244 therein at vertically spaced intervals along the height thereof, which aligns with a corresponding set of bolt holes 246 in the rear wall 214 of the injector frame 210. Using these aligned bolt holes, each cylinder block 224 is bolted to both the front and rear walls of the frame 210 for secure mounting of the cylinder block in a fixed, vertically upright position within the interior space of the frame at a short distance inward from the respective side wall 216, 218 of the frame.

Figure 3:
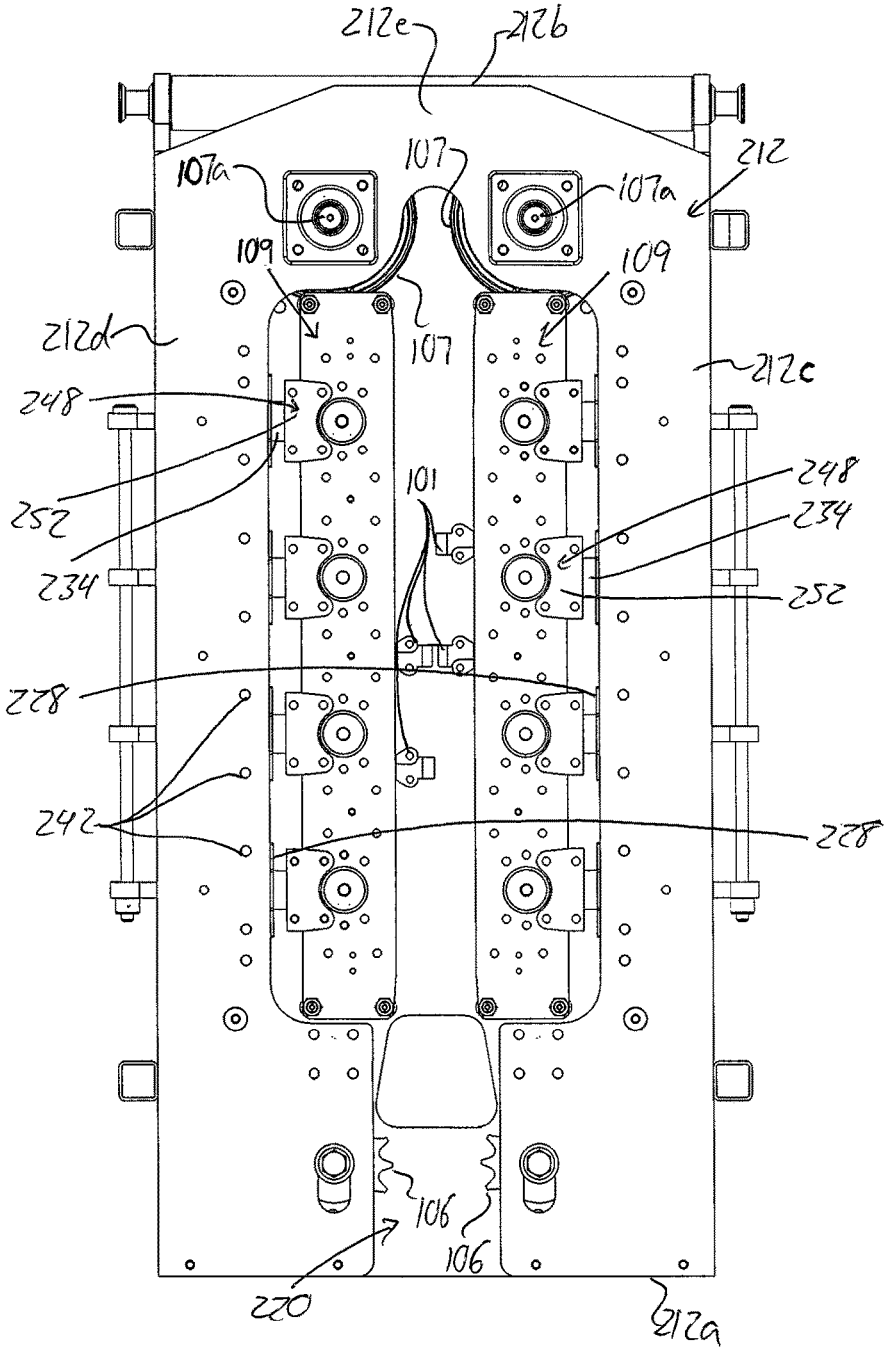
FIG. 3 is a front elevational view of the injection head of FIG. 2.
Figure 6B:
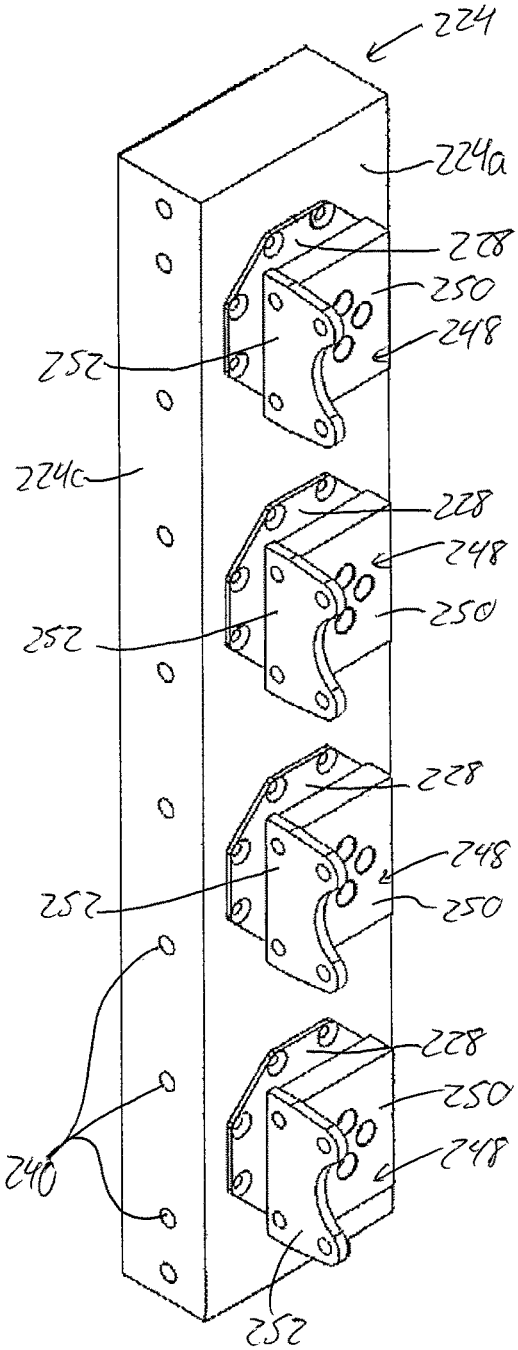
FIG. 6B is a perspective view of the cylinder block of FIG. 6A with support brackets mounted to the pistons for attachment of the respective skate thereto.

With reference to FIG. 6B, a right-angle support bracket 248 features a first plate 250 fastened to the piston rod 234 at the end face of thereof that lies distal to the piston 232. The first plate 250 lies in a vertical plane normal to the shared axis of the respective piston and cylindrical bore. A second plate 252 is bolted or otherwise attached to a front edge of the first plate to lie in a vertical plane perpendicular thereto at a position horizontally offset toward the front wall 212 of the frame 210 from the shared axis of the piston and cylindrical bore. As best shown in FIG. 3, for each cylinder block 224, the second plate 252 of each support bracket 248 is bolted to the respective skate 109 at a front face thereof that faces toward the plane of the front wall 212 of the frame 210. The skate 109 is thus carried on the piston rods 234 in a position abutted against the first plates 250 of the support brackets 248. Accordingly, each skate 109 is carried by the bank of pistons 232 in the respective cylinder block 212, whereby extension of the pistons of the two cylinder blocks will drive the two skates 109 toward one another to exert a gripping pressure the continuous string 110 between the gripper dies 101 of the two conveyor chains of the injector. Retraction of the pistons of the two cylinder blocks pulls the two skates 109 away from one another to release the gripping pressure.

By using the cylinder blocks and the banks of pistons housed therein to push and pull the skates instead of using conventional hydraulic cylinders coupled between the two skates, horizontal access to the space or pathway between the two conveyor chains is possible through the opening 220 in the front wall of the frame 210. Accordingly, the injector can be placed in an operational position on an existing downhole string of continuous rod by supporting the injector in a position beside an above-grade upper end of the continuous string, with the bridging portion 212*e* of the front wall at an elevation shortly above the upper end of the continuous string. Then, with the skates retracted away from one another to open up access to the pathway between them, the injector is shifted horizontally toward the string in order to receive the string in the pathway via the opening 220 in the front wall 212. The gap provided by the opening in the front wall aligns with the pathway between the conveyor chains, thus enabling this lateral entrance and exit of the continuous string to and from the pathway via the horizontal gap in the front wall of the frame. The opening 220 in the front wall thus defines an open front face of the injector through which the string conveyance pathway is accessible.

With reference to FIG. 2, a guide member 254 is provided in the form of a horizontal plate spanning between the front and rear walls 212, 214 at the top ends thereof in a position overlying the pathway between the two endless chain conveyors. A central opening 256 passes downwardly through the guide member to enable feeding of a spooled continuous string into the pathway through the guide member to enable injection of the spooled continuous string into the well. The guide member 254 and the bridging portion 212*e* of the front wall 210 act to reinforce the shape of the frame 210 while maintaining the open-face structure of the front wall over the majority of its height to enable lateral installation of the injector on a previously deployed string. However, in other embodiments, the guide member and front wall bridging portion may be omitted, whereby the opening 20 spans the full height of the front wall, and thereby completely separates the side portions of the front wall from one another.

Figure 4:
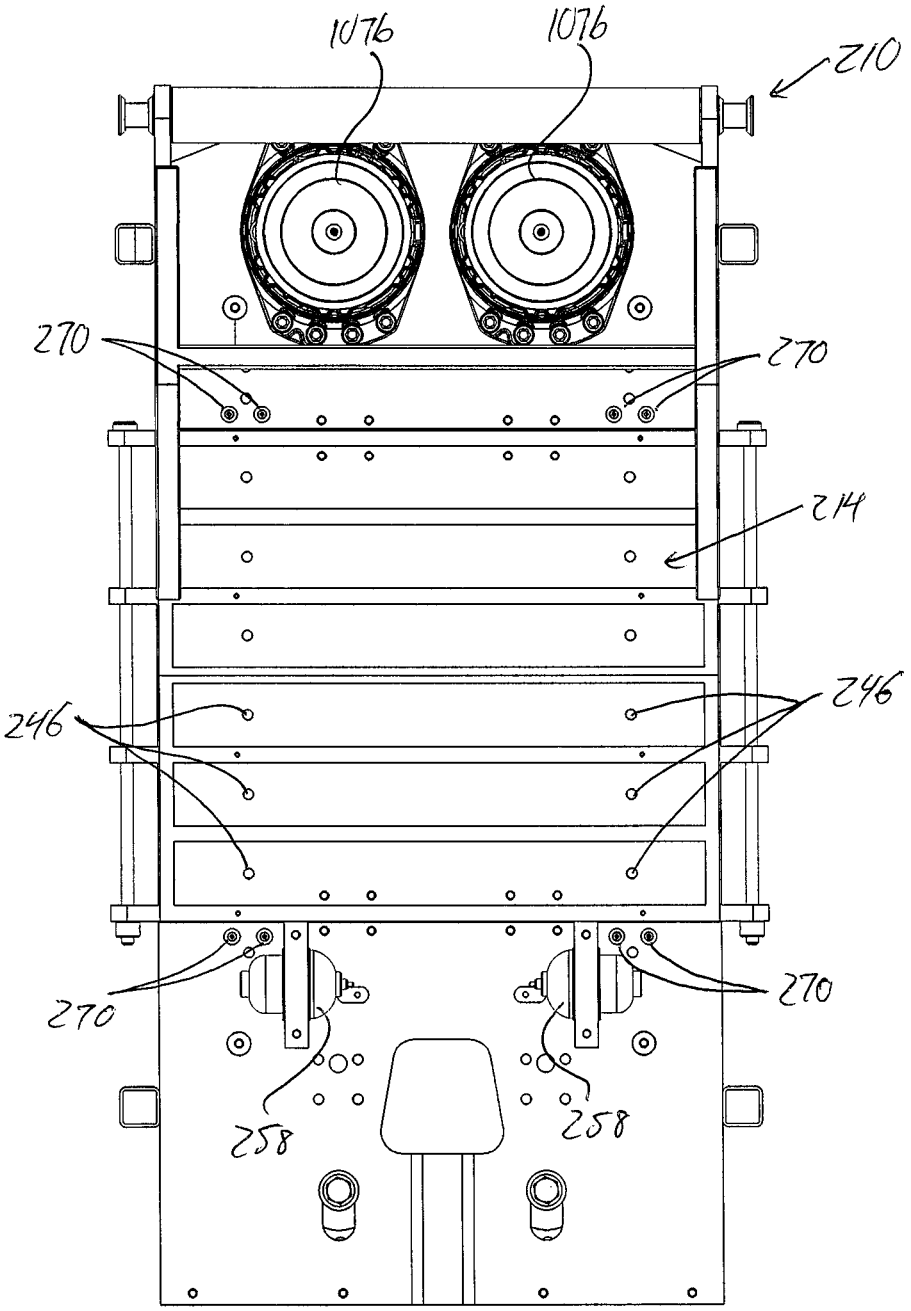
FIG. 4 is a rear elevational view of the injection head of FIG. 2.

With reference to FIG. 4, a pair of hydraulic accumulators 258 are mounted to the rear wall 214 at the out surface thereof that faces out of the interior space of the frame and away from the front wall 212. Using suitable hydraulic hoses (not shown), each accumulator is connected between the extension side inlet port of a respective one of the cylinder blocks 224 and the respective source of pressurized hydraulic fluid in order to minimize pulsations and compensate for high demand conditions to ensure confident gripping of the continuous string by the gripper dies under the skate pressure applied by the two banks of cylinders. The accumulators also compensate for pressure differences in the event that something larger than the expected rod size (e.g. a rod weld/upset or bullet, i.e. thread protector) is run through the injector. This provides a self-adjusting feature to automatically accommodate such variation in the strings being run by the injector.

Figure 7:
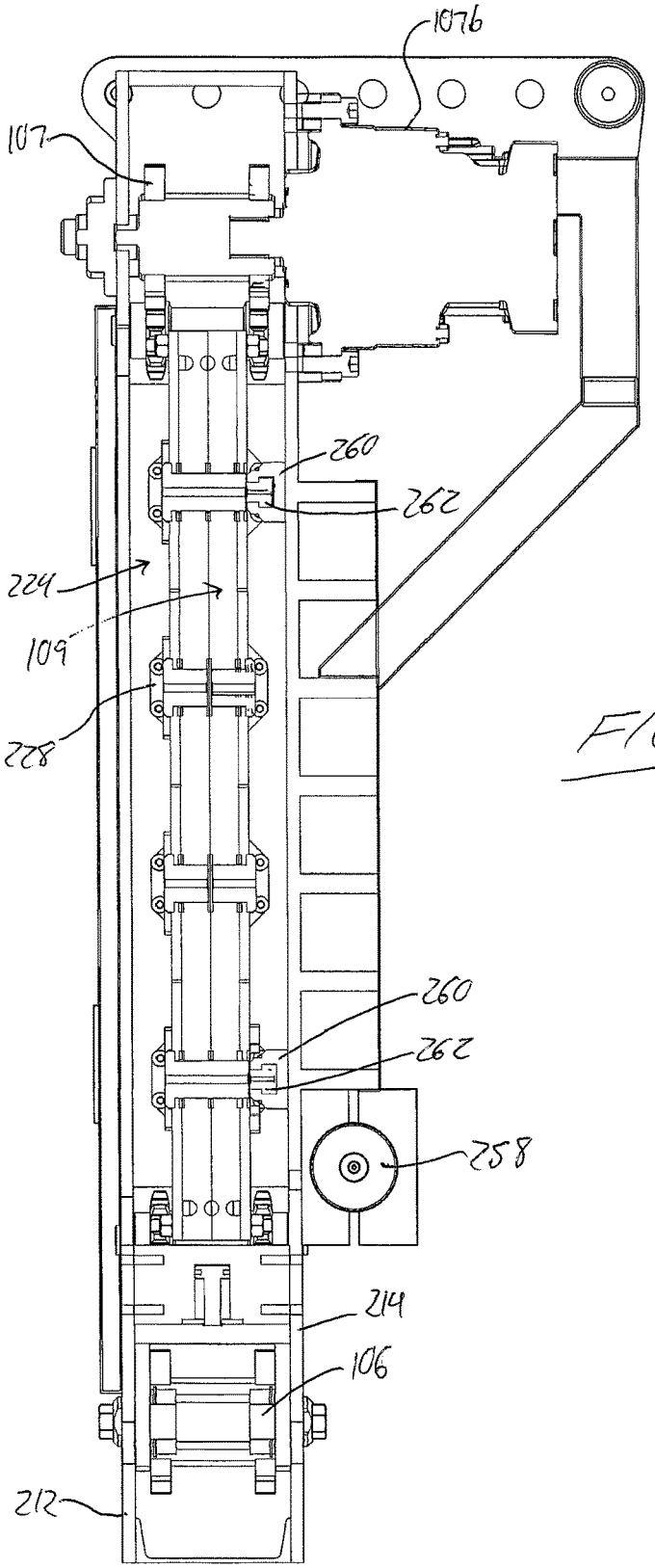
FIG. 7 is a cross-sectional side view of the injection head of FIG. 2 illustrating sliding support of the skates on a frame of the injection head by slide rails mounted on a rear wall of the frame.
Figure 8:
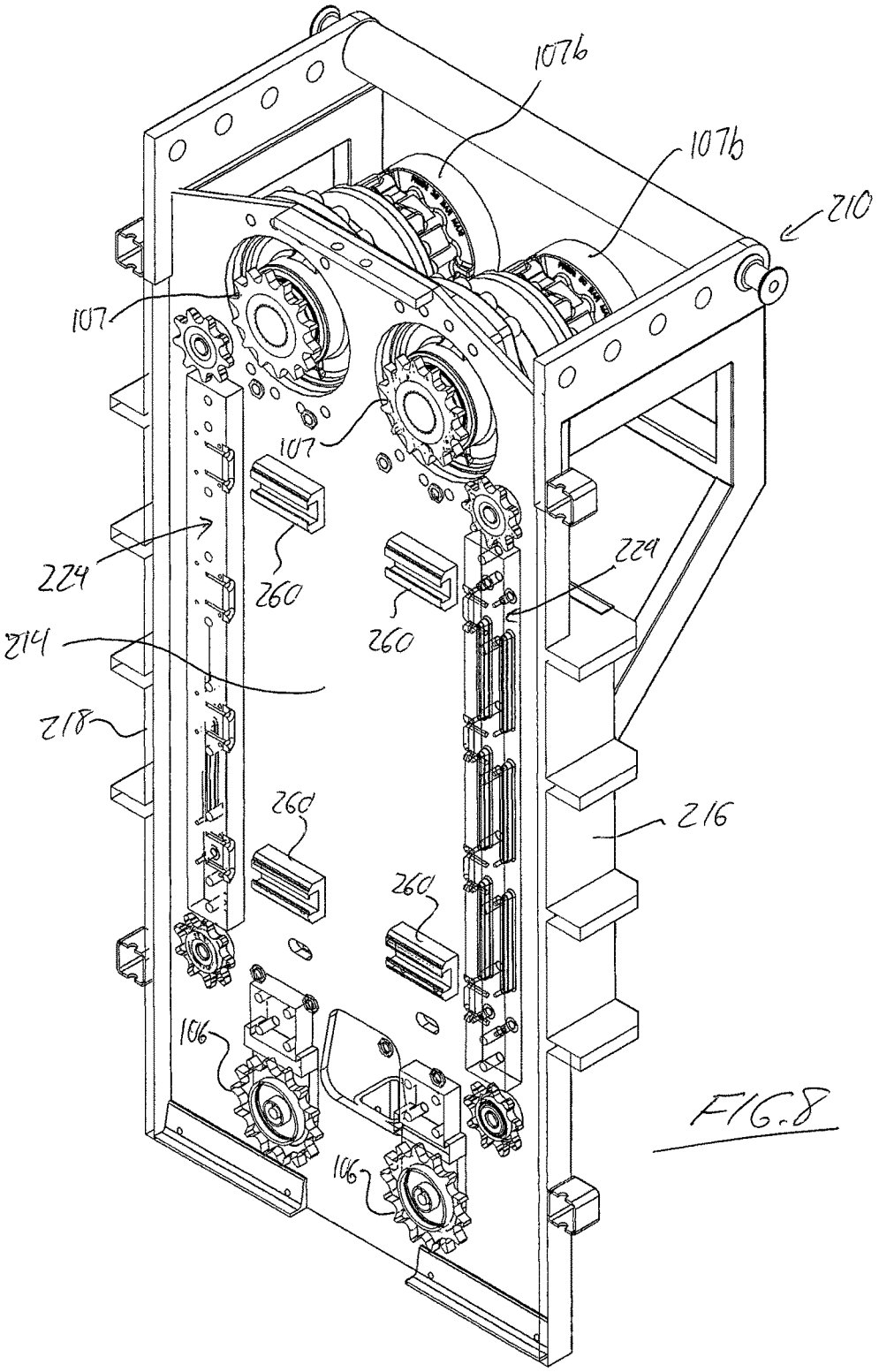
FIG. 8 is a cross-sectioned perspective view of the injector head of Figure showing the slide rails on the rear wall of the frame.

With reference to FIGS. 7 and 8, a plurality of slide rails 260 are mounted to the front face of the rear wall 214 of the frame 210, each defining a horizontally extending slide channel lying parallel to the axes of the cylindrical bores of the cylinder blocks so as to also lie parallel to the resulting displacement direction of the skates. In the illustrated embodiment, there are two slide rails per skate, one near the top end of the skate and one near the bottom end thereof. With particular reference to FIG. 7, each skate features two slide blocks 262 bolted or otherwise attached thereto at the rear face thereof, each one slidably engaged in a respective on of the slide rails 260 on the rear wall of the frame for sliding movement back and forth in the horizontal channel of the rail 260. The rails and blocks thus define cooperating slide members that constrain the skates to horizontal movement under extension and retraction of the banks of pistons in the two cylinder blocks. It will be appreciated that the number and positions of the cooperate pairs of slide members may be varied from the four-pair configuration of the illustrated embodiment.

Although the illustrated embodiment is described as having the inlet ports adjacent the bottom ends of the cylinder blocks and the outlet ports adjacent the top ends of the cylinder blocks, this configuration may be reversed for the extension side and/or retraction side ports of one or both cylinder blocks. Similarly, while the illustrated embodiment has the extension side and retraction side ports and corresponding fluid connection slots in the rear face of the cylinder block (and accessible through corresponding holes 270 in the rear wall of the frame, as can be seen in FIG. 4), the extension side and/or retraction side ports and slots may be relocated to other areas of the cylinder block. Likewise, the attachment between piston rods 34 and the skates 109 may vary from the particular support brackets described and illustrated herein. While the illustrated embodiment includes retraction ports to drive pressurized retraction of the pistons, in other embodiments the relief of pressure on the opposing side of the piston by the termination of pressurized flow through the extension ports may sufficient to release the continuous well string, and retraction ports may accordingly be omitted.

Since various modifications can be made in my invention as herein above described, and many apparently widely different embodiments of same made within the scope of the claims without departure from such scope, it is intended that all matter contained in the accompanying specification shall be interpreted as illustrative only and not in a limiting sense.

The invention of claimed is:

1. An apparatus for injecting or withdrawing a continuous string into and from a wellbore, the apparatus comprising:

a frame;

a pair of endless drive conveyors positioned on different respective sides of a pathway in which a length of the continuous string is receivable, each endless drive conveyor comprising an endless chain and a plurality of gripper dies coupled to the endless chain, each gripping die having a gripping face that faces outwardly from the endless chain and is shaped to engage a periphery of the continuous string and a base surface that faces inwardly from the endless chain, the endless chains entrained about respective set of sprockets that are rotatably mounted on the framework for driven movement around respective closed-loop paths on the different sides of the pathway such that the gripper dies of each endless chain are conveyed in a same direction along the pathway at the respective side thereof during a portion of the respective closed-loop path;

a pair of skates respectively residing on the different respective sides of the pathway with the closed-loop path of each endless chain closing around a respective one of the skates; and a pair of cylinder blocks respectively residing within the closed loop paths of the endless chains, each cylinder block featuring a plurality of blind bores having open ends facing toward the one of the skates located within the closed-loop path of the same endless chain, and closed ends lying opposite to said open ends;

a respective piston disposed within each bore and slidable back and forth in an axial direction of the bore;

a respective connection between each piston and the one of the skates located within the closed-loop path of the same endless chain, whereby back forth displacement of the pistons within each cylinder block causes back and forth displacement of the one of the skates located within the closed-loop path of the same endless chain, thereby moving the skate toward and away from the cylinder block; and hydraulic extension ports opening into the bores of each cylinder block between the pistons and the closed ends of the bores for extension of said skate away from the cylinder block under pressurized introduction of hydraulic fluid into the bores through said hydraulic extension ports.

2. The apparatus of claim 1 wherein the frame comprises front and rear walls standing upright on opposite sides of the skates and the pathway therebetween, each cylinder block being fastened to each of the front and rear walls and residing in a space between said front and rear walls, within which the skates are movable toward one another by pressurization of the bores of both skates through the hydraulic extension ports thereof to grip the length of continuous string, and the front wall being split into two portions separated by a horizontal gap therebetween, the horizontal gap being elongated in an upright direction and aligning with the pathway between the endless drive conveyors to enable lateral entrance and exit of the continuous string to and from the pathway via the horizontal gap in the front wall of the frame.

3. The apparatus of claim 2 wherein the gap in the front wall extends from a bottom end of the front wall toward an opposing top end thereof, and stops short of said top end to leave a bridging portion of the front wall intact over the gap to connect the two portions of the front wall together.

4. The apparatus of claim 3 comprising a guide member spanning between the front and rear walls at the top end in a position overlying the pathway between the two endless chain conveyors, and having an opening passing downwardly through the guide member to enable feeding of the length of continuous string into the pathway through the guide member.

5. The apparatus of claim 1 wherein the hydraulic extension ports of each cylinder block are in fluid communication with one another, and a single respective fluid supply line is connected to each cylinder block for supplying hydraulic fluid to all of the hydraulic extension ports.

6. The apparatus of claim 5 wherein the hydraulic extension ports of each cylinder block are communicated with one another via a respective set of extension-side fluid connection passages recessed into said cylinder block.

7. The apparatus of claim 1 further comprising hydraulic retraction ports opening into the bores on sides of the pistons opposite to the hydraulic extension ports for retraction of said skate toward the cylinder block under pressurized introduction of hydraulic fluid into the bores through said hydraulic retraction ports.

8. The apparatus of claim 7 wherein the hydraulic retraction ports of the bores in each cylinder block are in fluid communication with one another, and a single respective fluid return line is connected to each cylinder block for supplying hydraulic fluid to all of the hydraulic retraction ports.

9. The apparatus of claim 8 wherein the hydraulic retraction ports of each cylinder block are communicated with one another via a respective set of retraction-side fluid connection passages recessed into said cylinder block.

10. The apparatus of claim 1 comprising at least one hydraulic accumulator connected between a hydraulic fluid source and the hydraulic extension ports of the cylinder blocks.

11. The apparatus of claim 10 wherein the at least one hydraulic accumulator comprises a first and second hydraulic accumulators respectively connected to the pair of cylinder blocks.

12. The apparatus of claim 1 comprising a respective retaining flange for each bore, said respectively retaining flange being mounted to a face of the bore at which the open end of the cylinder bore resides and partly occluding said open end of the bore to prevent exit of the piston from the bore during extension of the piston.

13. The apparatus of claim 1 comprising at least one pair of mating slide members for each skate, each pair comprising a first slide member mounted on the respective skate, and a second slide member mated with the first slide member and mounted on the frame, the first and second slide members being slidable relative to one another on an axis lying parallel to the axial direction of the bores in the cylinder blocks to guide movement of the respective skate under actuation of the pistons.

14. An apparatus for injecting or withdrawing a continuous string into and from a wellbore, the apparatus comprising:

an upright framework;

a pair of endless drive conveyors positioned on different respective sides of a pathway in which a length of the continuous string is receivable, each endless drive conveyor comprising an endless chain and a plurality of gripper dies coupled to the endless chain, each gripper die having a gripping face that faces outwardly from the endless chain and is shaped to engage a periphery of the continuous string and a base surface that faces inwardly from the endless chain, the endless chains entrained about respective set of sprockets that are rotatably mounted on the framework for driven movement around respective closed-loop paths on the different sides of the pathway such that the gripper dies of each endless chain are conveyed in a same direction along the pathway at the respective side thereof during a portion of the respective closed-loop path;

a pair of skates respectively residing on the different respective sides of the pathway with the closed-loop path of each endless chain closing around a respective one of the skates; and a pair of cylinder blocks respectively residing within the closed loop paths of the endless chains, each cylinder block featuring a plurality of bores having open ends facing toward the one of the skates located within the closed-loop path of the same endless chain;

a respective piston disposed within each bore and slidable back and forth in an axial direction of the bore; and hydraulic extension ports opening into the bores of each cylinder block between the pistons and the closed ends of the bores for extension of said skate away from the cylinder block under pressurized introduction of hydraulic fluid into the bores through said hydraulic extension ports;

wherein the upright frame comprises front and rear walls standing upright on opposite sides of the skates and the pathway therebetween, each cylinder block being fastened to each of the front and rear walls and residing in a space between said front and rear walls, within which the skates are movable toward one another by pressurization of the bores of both skates through the hydraulic extension ports thereof to grip the length of continuous string, and the front wall being split into two portions separated by a horizontal gap therebetween, the horizontal gap being elongated in an upright direction and aligning with the pathway between the endless drive conveyors to enable lateral entrance and exit of the continuous string to and from the pathway via the horizontal gap in the front wall of the frame.

* * * * *